US006296335B1

(12) United States Patent
Compagnucci

(10) Patent No.: US 6,296,335 B1
(45) Date of Patent: Oct. 2, 2001

(54) LUMINOUS ROD USED TO SUPPORT REVOLVING SHELVES INSIDE CABINETS

(75) Inventor: Rossano Compagnucci, Osimo (IT)

(73) Assignee: Compagnucci-S.p.A. (IT)

( * ) Notice: Subject to any disclaimer, the term of this patent is extended or adjusted under 35 U.S.C. 154(b) by 0 days.

(21) Appl. No.: 09/543,970

(22) Filed: Apr. 7, 2000

(30) Foreign Application Priority Data

Apr. 15, 1999 (IT) ..... AN99U0018

(51) Int. Cl.[7] ..... A47B 96/14

(52) U.S. Cl. ..... 312/223.5; 211/133.4; 108/23

(58) Field of Search ..... 312/223.5; 108/50.02, 108/90, 23; 211/1.51, 133.4; 362/127, 132, 133, 134, 806

(56) References Cited

U.S. PATENT DOCUMENTS 3,819,924 * 6/1974 Thomas et al. ..... 240/2 SL
5,057,978 * 10/1991 Conti ..... 312/223.5

* cited by examiner

*Primary Examiner*—Peter M. Cuomo
*Assistant Examiner*—Michael J. Fisher
(74) *Attorney, Agent, or Firm*—Leonard Bloom

(57) ABSTRACT

A vertical tubular rod used inside cabinets to support revolving shelves. The rod is made of transparent materials and capable of housing a neon tube inserted therein. The neon tube is electrically powered at the ends of the transparent rod.

5 Claims, 1 Drawing Sheet

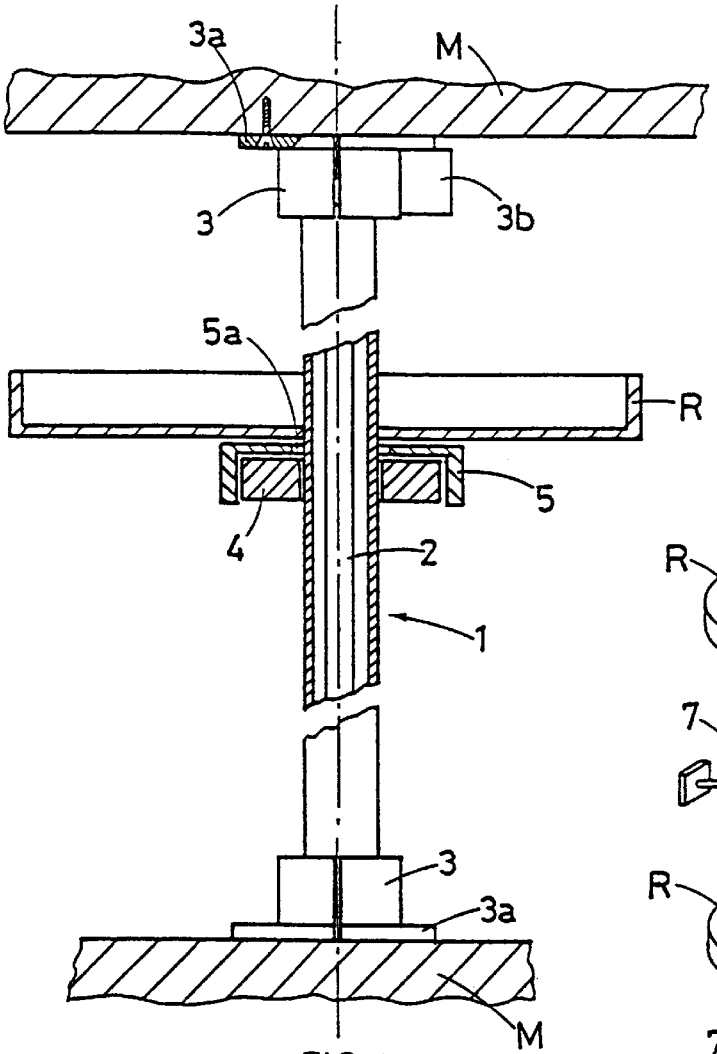
FIG.1
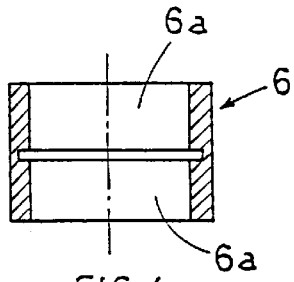
FIG.4
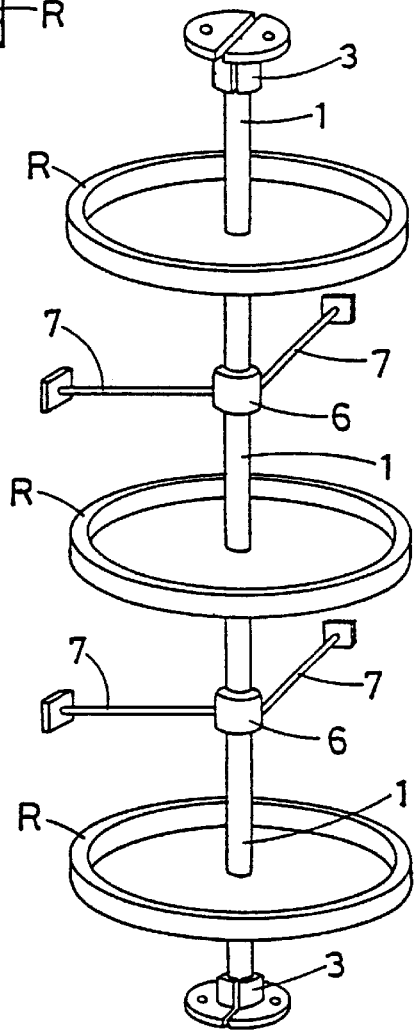
FIG.3
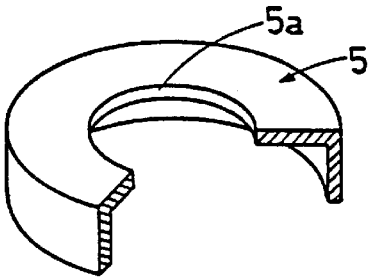
FIG. 2
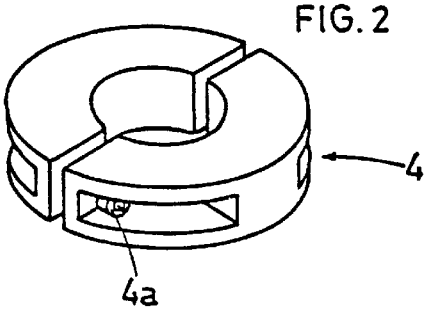

LUMINOUS ROD USED TO SUPPORT REVOLVING SHELVES INSIDE CABINETS

BACKGROUND OF THE INVENTION

1. Field of the Invention

The present patent application relates to a luminous vertical rod used to support revolving shelves inside cabinets, especially in the kitchen, and corner cupboards.

2. Description of Related Art

As it is known, revolving shelves or baskets are often mounted inside cabinets. They are inserted and supported by suitable vertical rods fixed between the two horizontal walls of the cabinets. The cabinets are often very deep since the rotation of the internal shelves makes it comfortable for the user to get the objects positioned on the shelves.

The practical use of this type of cabinets, however, has shown a significant disadvantage due to the poor visibility inside the cabinets, which is mainly due to the considerable depth that prevents the external light from reaching the most distant areas with respect to the access opening.

It appears evident that the reduced visibility can create considerable discomfort for the users, first of all, the difficult identification of a specific object inside the cabinet or of a specific space on which to place the object.

SUMMARY OF THE INVENTION

In view of the above inconvenience, the luminous vertical rod according to the invention has been devised. As explained in more detail in the description, when installed inside a cabinet, the luminous vertical rod provides an efficient light source, while improving the esthetical appearance and technological character of the cabinet, as requested by consumers.

In particular, the vertical rod according to the invention is made of transparent plastic materials and is capable of internally housing a neon tube. Thanks to the transparent structure of the rod, the light emitted by the neon tube can efficiently light the entire cabinet compartment, thus allowing for the optimal use of the space by the users.

To facilitate the disassembly of the rod when replacing the neon tube, the ends of the rod are fixed against the internal side of the two horizontal walls of the cabinets by means of suitable sleeves. Each sleeve is made up of two identical half shells that are suitably tightened, but at the same time easy to uncouple, in order to free the end of the rod according to the invention.

The electrical connections that allow for inserting the ends of the neon tube and its power supply components are preferably contained inside the sleeves used to fix the rod according to the invention. One of the sleeves externally supports the box with the electrical components necessary to operate the neon tube, which are connected to the electrical mains by a switch.

To this end, it must be noted that on/off switch of the neon tube contained in the vertical rod can be of manual (in this case mounted outside or inside the cabinet, in an easily accessible position for the user) or automatic type, automatically activated when opening or closing the cabinet door.

Two or more luminous vertical rods can be used in the case of very high cabinets. The presence of a single rod with considerable height would cause problems in finding a neon tube with the same height, assembling and permanently fixing it inside the cabinet.

When installing several rods, a special coupling with electrical contacts must be provided in intermediate position between two consecutive rods so that the switch can simultaneously turn on all the neon tubes contained in the same cabinet.

This coupling is preferably represented by a sleeve internally provided with a central horizontal element. The element limits two cylindrical cavities aligned in vertical position. The function of the lower cavity is to allow for inserting the top end of the lower tube neon, while the purpose of the upper cavity is to allow for inserting the lower end of the upper tube neon.

For major clarity the description of the invention continues with reference to the enclosed drawing, which is intended for purposes of illustration and not in a limiting sense, whereby:

BRIEF DESCRIPTION OF THE DRAWINGS

FIG. 1 is a front view of the luminous rod, partially sectioned, fixed inside a cabinet;

FIG. 2 is an axonometric exploded view that allows for verifying the structure of a clamp with cover used on the rod to support the revolving shelves;

FIG. 3 is an axonometric view of the internal compartment of a cabinet in which three sections of the luminous vertical rod according to the invention have been assembled;

FIG. 4 is a section view of FIG. 3 showing two cavities in the opening.

DESCRIPTION OF PREFERRED EMBODIMENTS

With reference to the aforementioned figures, the rod with tubular structure according to the invention (1) is made of transparent plastic materials and designed to exactly contain a neon tube (2).

The two ends of the rod (1) are fixed against the internal side of the two horizontal walls of a cabinet (M) by means of two cylindrical sleeves (3)provided with a large circular flange **(3*a*) and holes for screws or similar fixing means; it being provided that the bottom of the sleeves houses the electrical contacts that are necessary to insert and electrically power the neon tube (2)**.

As mentioned earlier, in order to facilitate the fast assembly/disassembly of the rod (1), each sleeve (3) is made up of two identical halves, in symmetrical opposite position with respect to the longitudinal axis, capable of being tightened with traditional means, such as screws, collars, click couplings, etc. In the luminous rod (1) shown in the enclosed figures, the upper sleeve (3) externally incorporates a box **(3*b*) with the electrical components for the operation of the neon tube (2)**.

Since the rod (1) is designed to horizontally support one or more revolving shelves (R), the same rod (1) is provided with a corresponding number of traditional clamps (4), of the type shown in FIG. 2.

Each clamp (4) is made up of two identical symmetrical "C" jaws capable of embracing a section of the rod (1) and being tightened by means of suitable screws with horizontal axis **(4*a*)**.

A box-type cover (5) is provided to conceal the clamp (4) and create a perfectly flat annular surface around the rod (1). The cover (5)is first inserted onto the rod (1) through a suitable central hole **(5*a*) and then exactly applied over the clamp (4)** in order to contain it and perfectly conceal it.

FIG. 3 shows a luminous rod with multiple height designed for very high cabinets. This version is obtained by connecting various sections of the luminous rod (1) by means of suitable couplings (6) provided with two cavities **(6*a*) with opposite openings as shown in FIG. 4. In particular, each coupling (6) is fixed to the internal walls of the cabinet (with the obvious exception of the door) by means of suitable radial arms (7)** with horizontal axis capable to ensure the stability of the multiple rod.

What is claimed is:

1. In a cabinet having revolving shelves therein, between horizontal walls, the improvement being a tubular rod having a first end and an opposite second end, the rod being disposed vertically along a longitudinal axis between the horizontal walls of the cabinet and supporting said revolving shelves, the rod being formed of transparent materials, a neon tube being received in the tubular rod and electrical power being provided to power the neon tube.

2. The improvement of claim 1, further comprising a pair of cylindrical sleeves, each cylindrical sleeve having a fixing flange thereon, each flange being mounted on opposite horizontal walls of the cabinet, electrical contacts being housed in each of the cylindrical sleeves, the ends of the rod being received in respective cylindrical sleeves, and the electrical contacts engaging the neon tube.

3. The improvement of claim 2, wherein each flange has two identical halves in symmetrically opposing positions with respect to the longitudinal axis of the tubular rod, and means for tightening said flanges wherein assembly/disassembly of the rod is facilitated.

4. The improvement of claim 1, further comprising the rod having sections, a coupling disposed between the sections, the coupling having two internal cavities, and radial arms on a horizontal axis connecting the coupling to the cabinet.

5. The improvement of claim 1, further comprising at least one clamp adjustably connected to the rod, the at least one clamp horizontally supporting the revolving shelf.

* * * * *